US009741239B2

(12) United States Patent
Okeefe et al.

(10) Patent No.: US 9,741,239 B2
(45) Date of Patent: Aug. 22, 2017

(54) SYSTEMS AND METHODS OF CALIBRATING REPLACEMENT ALARM CONTROL PANELS

(71) Applicant: Honeywell International Inc., Morristown, NJ (US)

(72) Inventors: Mark Okeefe, San Diego, CA (US); David Llenaresas, San Diego, CA (US); Kenneth Eskildsen, Great Neck, NY (US); Tom Winkeler, Saint James, NY (US); Yuxia Lu, South Setauket, NY (US); Dave Mole, Medford, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/639,372

(22) Filed: Mar. 5, 2015

(65) Prior Publication Data

US 2015/0254971 A1 Sep. 10, 2015

Related U.S. Application Data

(60) Provisional application No. 61/950,347, filed on Mar. 10, 2014.

(51) Int. Cl.
*G08B 29/00* (2006.01)
*G08B 29/12* (2006.01)

(52) U.S. Cl.
CPC ..... *G08B 29/126* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,104,286 | A * | 8/2000 | Luquette | G08B 25/04 340/506 |
| 2004/0051643 | A1* | 3/2004 | Bullmore | G08B 13/22 340/635 |
| 2006/0192666 | A1* | 8/2006 | Parker | G08B 25/04 340/507 |
| 2010/0052928 | A1* | 3/2010 | Tabib | G08B 29/24 340/653 |
| 2015/0054522 | A1* | 2/2015 | Boettger | G08B 29/123 324/509 |

* cited by examiner

*Primary Examiner* — Travis Hunnings
(74) *Attorney, Agent, or Firm* — Husch Blackwell LLP

(57) ABSTRACT

An apparatus and method of up-dating an existing alarm monitoring system control panel having installed wire loops, with detectors coupled thereto, and installed end-of-line resistors. Upon removal of the existing control panel, the loops are coupled to an up-graded control panel having an adjustable loop interface. The existing loops can be coupled to the adjustable loop interface. The interface automatically determines operating loop voltages in view of existing end-of-line resistors. Detectors on the loops can be read without any changes needed to end-of-line resistor values. Determined operating loop voltages can be digitized and stored in the up-graded control panel for subsequent use in monitoring loop operating characteristics.

13 Claims, 2 Drawing Sheets

SYSTEMS AND METHODS OF CALIBRATING REPLACEMENT ALARM CONTROL PANELS

CROSS-REFERENCE TO RELATED APPLICATION

This application claims the benefit of the filing date of U.S. Provisional Application Ser. No. 61/950,347 filed Mar. 10, 2014, entitled, "Systems and Methods for Calibrating Alarm Panels and Determining End of Line". The '347 application is hereby incorporated herein by reference.

FIELD

The application pertains to replacement, multi-mode alarm system control units. More particularly, the applications pertains to such control units which provide wireless communications with ambient condition detectors, and, continuing communications with previously installed detectors which communicate via a wired medium.

BACKGROUND

Recently, there has been significant interest and demand for wireless alarm systems. Accordingly, dealers, technicians and installers of alarm systems have been attempting to modify traditional hardwired alarm panels for purposes of adapting and incorporating them into a wireless alarm system. Such traditional hard wired systems typically have resistors on the wire runs throughout the building or structure in which they are installed. These resistors can be located at a window, in the building frame or within the walls.

In order to upgrade or replace an existing alarm panel that has traditional hardwired loops or zones, the end of line resistors of the wire runs have needed to be removed and updated resistors have been needed to be incorporated consistent with the new system. Many times, this involves digging into a wall or window frame, which can cause significant damage to the building structure and take up valuable install time. This in turn can lead to additional labor time and increase costs.

FIG. 1 illustrates a prior art monitoring system having a plurality of wired loops to which various types of detectors can be coupled. Each of the loops would usually have an end of line resistor.

Wired systems, such as system 10 in FIG. 1, at installation did not provide wireless communications with installed detectors. As illustrated in FIG. 1, in system 10, a control unit, or panel 12 is coupled via a zone interface to a plurality 14 of wire loops each of which terminates in an end-of-line resistor, such as resistors 16. Each of the wire loops supports a plurality of detectors, such as smoke, gas or thermal detectors. A displaced monitoring station M can communicate with panel 12 as would be understood by those of skill in the art. Any attempt at upgrading panel 12 has required addressing the end-of-line resistor problem.

DETAILED DESCRIPTION

Figure 1:
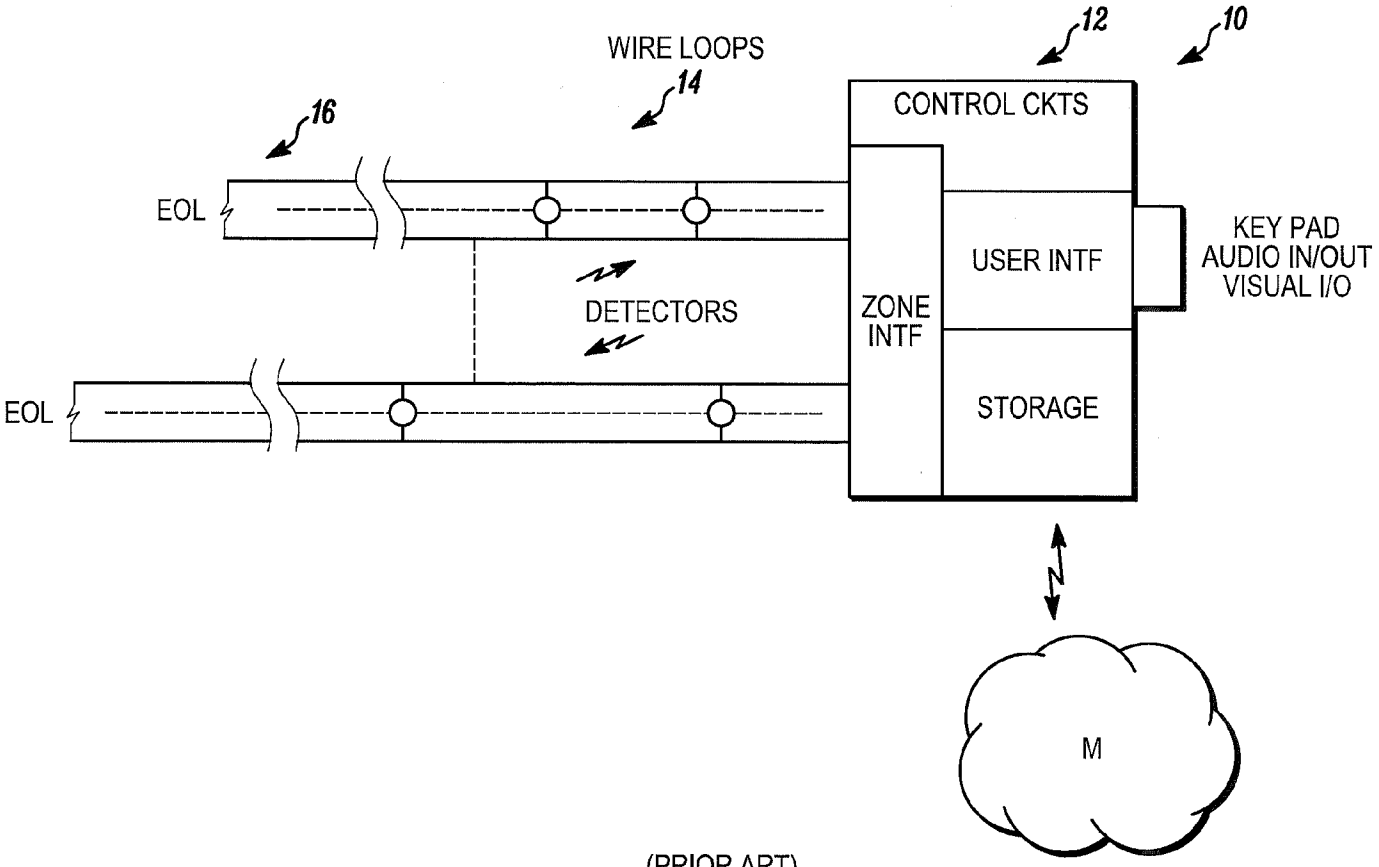
(PRIOR ART) FIG. 1
FIG. 1 illustrates a block diagram of a prior art system.

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

Embodiments presented herein provide systems and methods for calibration of an alarm panel that can allow a technician to automatically calibrate different zones or locations within a building structure. Embodiments further provide for determining and accommodating the existing end-of-Line ("EOL") resistances present in any hardwired zones installed by the original equipment manufacturers' product. A detected zone voltage is dependent on the value of an EOL resistor.

In operation, embodiments disclosed herein can provide a control panel, or converter module having a reference array. Prior to calibration, valid zones of the hardwired system can be placed into a restored loop state. When a calibration command is initiated, this array can be cleared and voltages sensed at each zone can be digitized and stored in the reference array.

The voltage on each zone within the system can be read at a predetermined or preset time interval, such as for example every 0.1 seconds, and compared against its earlier value in the reference array. Where the two values differ by a predetermined threshold, for instance 0.5 volts, the zone can be considered faulted and can be reported as such.

According to such embodiments, a technician can use any resistance on the wire run from about 2 k to 10 k which covers most conductance values. Activating the process, for example through the new panel's keypad, or, by pressing a calibration button, enables an installer to quickly and easily install the upgraded, wireless system while being able to continue to use the previously installed wired loops detectors, and most importantly, existing end-of-line resistors.

Accordingly, in accordance with embodiments hereof a subsequent alarm control unit, or panel, can be installed to replace an earlier, installed, alarm panel without requiring rewiring or replacing EOL resistors that may be located at other areas within a building. For example, an installer can go to the site of an alarm system previous installed by another vendor and disconnect the hardwired zones from that panel. Then in one embodiment, an interface module, or an updated, replacement panel can be installed and used to reconfigure/calibrate the zones so that they can be detected by the new alarm system and control panel which also can support wireless devices and communications. As a result of this process, the system can then automatically adjust itself to the end of line (EOL) resistor values of the previous installation.

Figure 2:
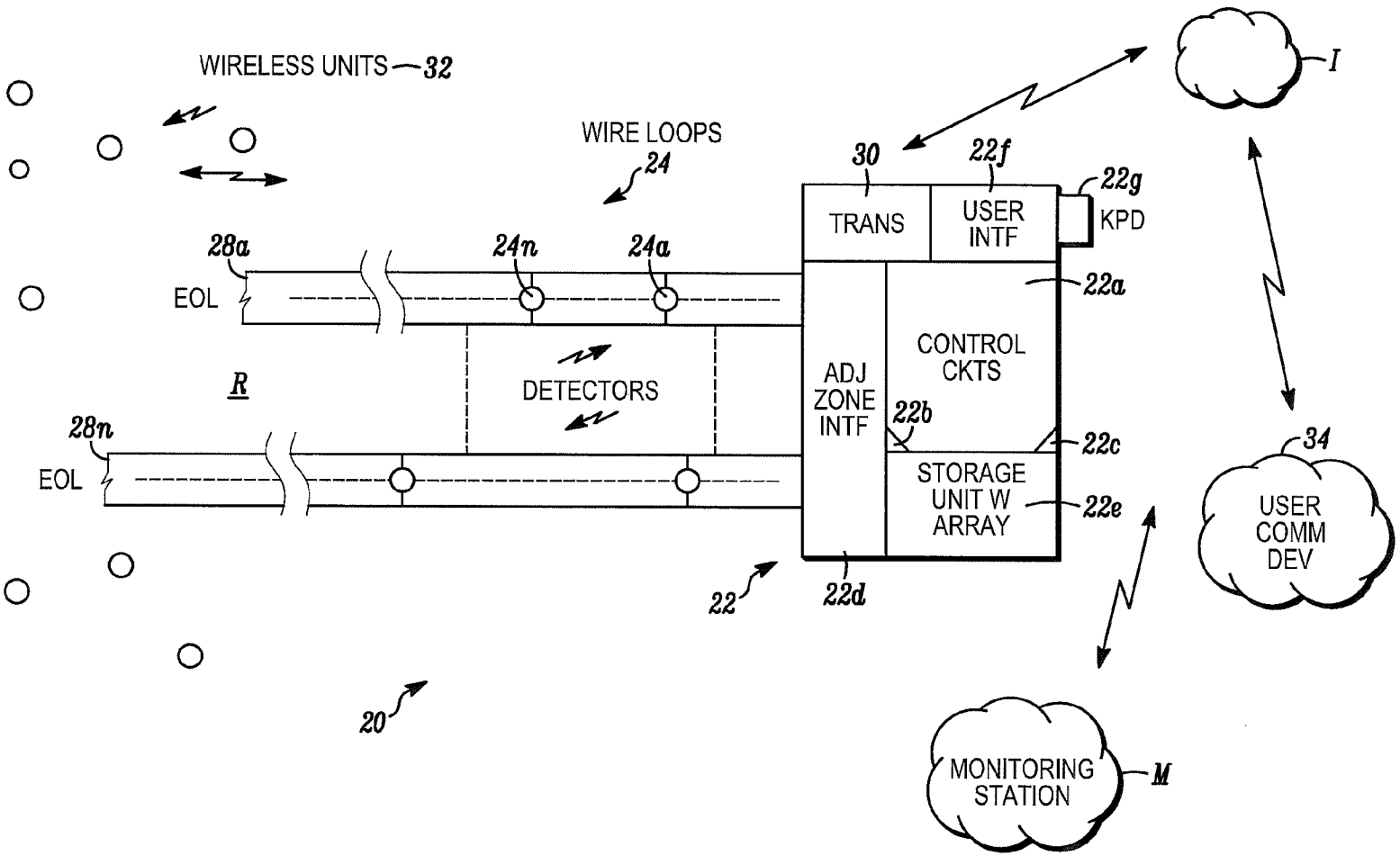
FIG. 2 is a block diagram of a monitoring system in accordance herewith.

FIG. 2 illustrates an embodiment 20 in accordance with the above. An updated control panel 22 has been coupled to a previously installed plurality of wired zones 24. Those of skill in the art will understood that the zones 24 would each include a wire loop to which is coupled a plurality of detectors or devices, such as 24*a*, 24*b* . . . 24*n*. Additionally, each of the members of the plurality of loops 24 can be expected to include an end of line resistor such as 28*a*, 28*b* . . . 28*n*.

The benefit of the replacement panel 22 is that it can automatically adjust to the existing, installed wire loops and associated end of line resistors. Further, as discussed below, the panel 22 can provide expanded services and capabilities.

The control unit, or panel, 22 includes control circuits 22*a* which can be implemented at least in part by a programmed processor 22*b* and executable control software 22*c*. An adjustable zone interface 22*d* is coupled to previously installed loops 24.

The interface 22*d* can adjust, in accordance with existing end-of-line resistance values to communicate with existing devices, such as 24*i*. No changes are needed in the resistor values of the loops.

The interface 22*d* can in one embodiment carry out the above described process to read and digitize the voltages from each of the zones, which depend on the value of the end-of-line resistors, such as 28*a*, 28*b* . . . 28*n*. The respective values can be stored in a local storage unit 22*e* as an array. Newly read resistor values can be compared to earlier values in that array. If the two values, for a given zone differ by a predetermined amount, for example by about one-half a volt, that zone can be considered to be exhibiting a faulted which can then be reported.

The panel 22 can also include a user interface 22*f* and a display or graphical user interface 22*g* on which fault information can be presented to an installer. Finally, wireless transceivers 30 coupled to the control circuits 22*c* can provide wireless communications with a plurality of wireless devices, or detectors 32 which can be installed in the region R being monitored.

Control panel 22 can also communicate wirelessly via transceivers 30, and via a computer network such as the interface I, with one or both of a monitoring station M or a user communication device 34, such as a wireless phone, pad computer or laptop.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A monitoring system comprising:

a single-mode wired control unit connected to a wire loop; and a multi-mode wired and wireless control unit that replaces the single-mode wired control unit by connecting the multi-mode wired and wireless control unit to the wire loop, wherein the multi-mode wired and wireless control unit determines an end-of-line resistance value of the wire loop to calibrate the multi-mode wired and wireless control unit to the wire loop, wherein the multi-mode wired and wireless control unit stores the end-of-line resistance value, wherein the multi-mode wired and wireless control unit includes an input-output port for communicating with the wire loop, wherein the multi-mode wired and wireless control unit stores a voltage value for the wire loop, wherein the multi-mode wired and wireless control unit compares the voltage value as stored to a current loop voltage value, and wherein the multi-mode wired and wireless control unit, responsive to results of comparing the voltage value as stored to the current loop voltage value, generates a trouble indicator when the current loop voltage value falls outside of a predetermined range indicative of acceptable operation.

2. A monitoring system as in claim 1 wherein the multi-mode wired and wireless control unit, responsive to the end-of-line resistance value, configures the multi-mode wired and wireless control unit consistent with the end-of-line resistance value.

3. A monitoring system as in claim 2 wherein the multi-mode wired and wireless control unit determines loop resistance values by measuring, for each loop, at least one loop voltage value when a respective loop is in a predetermined state.

4. A monitoring system as in claim 3 further comprising a removable module that determines the loop resistance values such that the multi-mode wired and wireless control unit, via the removable module, interacts with a least one of the wire loop, the wire loop and wireless devices, or the wireless devices.

5. A monitoring system as in claim 1 wherein the multi-mode wired and wireless control unit is calibrated by:

providing at least one adjustable interface for a plurality of zones;

placing all valid zones of the plurality of zones into a selected loop state;

clearing stored values of the end-of-line resistance value and the voltage value for the wire loop;

determining a digitized value of a voltage of each of the plurality of zones when in the selected loop state;

storing the digitized value of the voltage of each of the plurality of zones; and adjusting the at least one adjustable interface, responsive to the digitized value, so as to communicate with any detectors coupled to a respective one of the plurality of zones.

6. A monitoring system as in claim 5 wherein a current zone voltage is read at least intermittently and compared to the digitized value as stored.

7. A monitoring system as in claim 6 wherein, if-when the current zone voltage differs from the digitized value as stored by a predetermined amount, a fault indicator is generated.

8. A method of calibrating an alarm system comprising:

providing a single-mode wired control unit connected to a wired zone and to sensors of a hardwired alarm system through the wired zone;

replacing the single-mode wired control unit by connecting a multi-mode wired and wireless control unit having a reference array to the wired zone;

detecting the sensors;

placing the sensors in a selected loop state;

initiating a selected command to the multi-mode wired and wireless control unit;

clearing the reference array;

digitizing an output voltage for the wired zone;

storing the output voltage of the wired zone in the reference array;

detecting the output voltage of the wired zone at subsequent pre-established time intervals;

comparing the output voltage as detected to the output voltage as stored in the reference array; and when the output voltage as detected for the wired zone and the output voltage as stored for of the wired zone differ by a predetermined threshold, generating a fault indicator for the wired zone.

9. A method as in claim 8 further comprising providing a wireless transceiver and coupling the wireless transceiver to the multi-mode wired and wireless control unit, wherein the multi-mode wired and wireless control unit communicates with wireless devices as well as the sensors of the hardwired alarm system.

10. A method as in claim 8 further comprising applying one or more selected currents to the wired zone to determine a preferred operating voltage for the wired zone.

11. An apparatus comprising:

a single-mode wired control unit connected to a wired zone and to a detector through the wired zone;

a monitoring system control panel that replaces the single-mode wired control unit by coupling the monitoring system control panel to the wired zone, wherein the monitoring system control panel that includes adjustable zone interface circuits; and control circuits in the monitoring system control panel that enable the adjustable zone interface circuits to automatically compensate for differing end-of-line resistances, whereby an end-of-line resistor need not be replaced, wherein the adjustable zone interface circuits comprise storage circuits that store a voltage value for the wired zone having the end-of-line resistor, wherein the adjustable zone interface circuits compare the stored voltage value as stored to a current zone voltage value, and wherein the monitoring system control panel, responsive to results of comparing the voltage value as stored to the current zone voltage value, generates a trouble indicator when the current voltage value falls outside of a predetermined range indicative of acceptable operation.

12. An apparatus as in claim 11 further comprising a module coupled between the monitoring system control panel and the wired zone, wherein the module includes circuitry that automatically compensates for the voltage value for the wired zone having the end-of-line resistor.

13. An apparatus as in claim 12 wherein the module is in wireless communication with the monitoring system control panel.

* * * * *